US007444775B1

(12) United States Patent
Schuetz

(10) Patent No.: US 7,444,775 B1
(45) Date of Patent: Nov. 4, 2008

(54) CALIBER CONVERTIBLE AR-15 UPPER RECEIVER SYSTEM

(76) Inventor: Robert C. E. Schuetz, 2125 Quiemoth St. SE., Olympia, WA (US) 98513

( * ) Notice: Subject to any disclaimer, the term of this patent is extended or adjusted under 35 U.S.C. 154(b) by 233 days.

(21) Appl. No.: 11/519,288

(22) Filed: Sep. 12, 2006

Related U.S. Application Data

(60) Provisional application No. 60/717,548, filed on Sep. 14, 2005.

(51) Int. Cl.
*F41A 21/10* (2006.01)
*F41A 9/71* (2006.01)

(52) U.S. Cl. ..... 42/76.01; 42/77; 42/49.02; 89/29

(58) Field of Classification Search ..... 42/77, 42/76.01, 49.02; 89/29
See application file for complete search history.

(56) References Cited

U.S. PATENT DOCUMENTS

| | | | | | |
|---|---|---|---|---|---|
| 4,058,922 | A * | 11/1977 | Elbe et al. | 42/16 |
| 4,288,938 | A * | 9/1981 | Kahn | 42/59 |
| 4,316,339 | A * | 2/1982 | Herriott | 42/59 |
| 4,404,765 | A | 9/1983 | Reudelsterz et al. | |
| 4,531,446 | A * | 7/1985 | VanVoorhees | 89/29 |
| 4,648,192 | A * | 3/1987 | Harness | 42/77 |
| 4,729,186 | A * | 3/1988 | Rieger | 42/75.04 |
| 4,955,157 | A * | 9/1990 | Brighton et al. | 42/77 |
| H000926 | H * | 6/1991 | Mahtook | 89/128 |
| 5,228,887 | A * | 7/1993 | Mayer | 42/75.02 |
| 5,740,626 | A * | 4/1998 | Schuetz et al. | 42/106 |
| 5,937,563 | A | 8/1999 | Schuetz et al. | |
| 6,289,620 | B1 * | 9/2001 | Doria | 42/79 |
| 6,293,040 | B1 * | 9/2001 | Luth | 42/75.01 |
| 6,493,979 | B2 | 12/2002 | Katzmaier | |
| 6,769,209 | B2 * | 8/2004 | Mendoza-Orozco | 42/77 |
| 6,789,342 | B2 * | 9/2004 | Wonisch et al. | 42/75.02 |
| 7,121,035 | B2 * | 10/2006 | Greer | 42/77 |
| 7,302,881 | B1 * | 12/2007 | Tertin | 89/128 |
| 2001/0045045 | A1 * | 11/2001 | Katzmaier | 42/77 |
| 2004/0244258 | A1 | 12/2004 | O'Dwyer et al. | |
| 2006/0064914 | A1 * | 3/2006 | Greer | 42/77 |
| 2007/0277669 | A1 * | 12/2007 | Tertin | 89/128 |

* cited by examiner

*Primary Examiner*—Michael J Carone
*Assistant Examiner*—Michael D David
(74) *Attorney, Agent, or Firm*—Brian J. Coyne

(57) ABSTRACT

A system that converts an original equipment (OEM) AR-15 rifle to a rifle capable of firing cartridges of at least two different calibers. Two or more barrel liners are provided for cartridges of differing calibers. Each liner is insertable through a rear opening of an upper receiver portion of the rifle and into a smooth bore barrel of a modified barrel assembly. Each liner comprises a tube portion having a longitudinal bore and a head portion with an opening that communicates with said bore. An adapter bolt carrier assembly is substituted for the OEM AR-15 bolt carrier assembly. The substituted assembly includes a bolt that carries the firing pin and is slidably mounted on a rail guide. A front end of the rail guide has a tongue extension with a slot that receives a pin attached to a rear end of a liner head. A support rail is fixed to a rear end of the rail guide. A spring extends from the support rail to the bolt, thereby pressing the bolt against the liner head. A magazine insert, insertable into an OEM ammunition magazine, accepts cartridges of differing calibers.

14 Claims, 17 Drawing Sheets

CALIBER CONVERTIBLE AR-15 UPPER RECEIVER SYSTEM

CROSS REFERENCE TO RELATED APPLICATIONS

This application is related to U.S. provisional patent application No. 60/717,548 by the same applicant with filing date Sep. 14, 2005.

STATEMENT REGARDING FEDERALLY APPROVED RESEARCH OR DEVELOPMENT

None.

BACKGROUND OF THE INVENTION

1. Field of the Invention

This invention relates generally to manually operated, semiautomatic and automatic rifles and, in particular, to upper receiver assemblies for AR-15 rifles, especially those that can be converted for accurate firing of cartridges of at least two different calibers.

2. Background Art

Increased flexibility of use of a gun may be achieved by providing a system that permits the firing of cartridges of dissimilar caliber. For instance, military, police and civilian marksmen can thereby train with a firearm on indoor and short distance ranges and with relatively inexpensive rim fire cartridges, specialty training cartridges or pistol-type cartridges.

In the case of handguns, U.S. Pat. No. 6,493,979 to Katzmaier disclosed a system that included a first barrel removably mounted to a handgun, with the first barrel including a first cartridge chamber sized to permit placement of the first cartridge into the first barrel in firing position. The first cartridge chamber was sized to prevent placement of the second cartridge into the first cartridge chamber in the firing position. A second barrel was provided, which was interchangeable with the first barrel and which was also removably mounted to the handgun. The second barrel included a second cartridge chamber sized to permit placement of the second cartridge into the second barrel in the firing position, and the second cartridge chamber was sized to prevent placement of the first cartridge into the second cartridge chamber in the firing position.

U.S. Pat. No. 4,404,765 to Reudelsterz et al. disclosed a small caliber conversion assembly and small caliber cartridge for a large caliber gun, such as a field howitzer or a tank-borne gun, that utilized an adapter that was insertable into a large cartridge chamber of the gun. The adapter carried a small caliber cartridge and firing means for the small caliber cartridge that was responsive to the large caliber gun firing mechanism.

United States patent application Publication No. US 2004/0244258 of O'Dwyer et al. disclosed a barrel assembly for insertion into a parent barrel of a rifle that permitted the conversion of the gun barrel to a smaller caliber barrel using a barrel insert. The barrel assembly had a plurality of projectiles axially disposed within at least one barrel of the barrel assembly and associated with discrete selectively ignitable propellant charges for propelling the projectiles from said at least one barrel, wherein said barrel assembly included a parent barrel engaging means. In one embodiment, the barrel assembly comprised a single barrel. In another embodiment, the barrel assembly included a cluster of barrels aligned in a closed packed array for insertion into the parent barrel.

There remains a need, however, for a system that is capable of converting a manually operated, semiautomatic or automatic rifle for accurate firing of cartridges of at least two different calibers; and, there remains in particular a need for such a system that is capable of such a conversion of an AR-15 rifle. AR-15 is a trademark of the Colt Manufacturing Company of Hartford, Conn., and designates a civilian version of a military M-16 assault rifle.

SUMMARY OF THE INVENTION

According to the present invention, an original equipment manually operated, semiautomatic or automatic rifle of the kind that includes a lower receiver portion, an upper receiver portion housing a bolt carrier assembly and a charging handle, a barrel assembly, and an ammunition magazine insertable into the magazine well of the lower receiver portion, is modified to enable the rifle to use ammunition cartridges of two or more dissimilar calibers. The lower receiver portion remains unmodified. To accommodate ammunition cartridges of different calibers, a barrel liner of appropriate dimensions is provided for each desired caliber. The barrel assembly remains substantially the same, except that a smooth bore barrel is substituted for the original barrel and the barrel is dimensioned to receive the barrel liners. Each barrel liner includes an apertured barrel liner head disposed at a rear, firing chamber end of the liner and a liner tube having a bore aligned with the aperture of the liner head, such that bullets exiting the firing chamber pass through the aperture of the liner head and exit the barrel liner at the muzzle end of the barrel. Each head has a pair of spaced-apart legs, a liner engagement pin mounted between the legs on a first side of the head aperture, and a first slot disposed normal to the pin on an opposite side of the head aperture.

An adapter bolt carrier assembly is substituted for the original equipment bolt carrier assembly. A substitute upper receiver portion is provided that is substantially the same as the original equipment upper receiver portion, but it is dimensionally modified as necessary to receive and house the adapter bolt carrier assembly and a barrel liner. The adapter bolt carrier assembly includes a bolt within which is mounted a spring-loaded firing pin, and means for attaching and disattaching the head of a barrel liner from a front end of the bolt carrier assembly. In the preferred embodiment, the means for attaching and disattaching the liner head includes a rail guide that extends longitudinally from a rear end to an opposite, front end. The front end of the rail guide has a tongue extension with a second slot for receiving the liner engagement pin. The tongue extension is cut out on one side to receive one of the legs of a liner head and to permit the other leg to be placed adjacent to the tongue extension in side by side relation so that the legs straddle the tongue extension. Said means further includes a support rail fixed to the rear end of the guide rail and extending part way toward the front end of the support rail. The bolt is slidably mounted on the guide rail for movement between the support rail and the front end of the guide rail. Spring means is provided for urging the bolt away from the support rail and into engagement with the head of a liner. In the preferred embodiment, the spring means includes an apertured, rear lug mounted on the support rail; an apertured, front lug mounted to the bolt; a spring support pin disposed parallel to the guide rail and having a rear end inserted into the apertured first lug and an opposite, front end inserted into the apertured, second lug; and a coil spring mounted on the spring support pin between the first lug and the second lug. To attach or disattach a liner head from the front end of the adapter bolt carrier assembly, the bolt is manually retracted, thereby compressing the coil spring, which permits the liner engagement pin to be inserted into the second slot for attaching the liner head, or to be withdrawn from the second slot for disattaching the liner head; thereafter, the coil spring is permitted to force the bolt forward into engagement with the liner head once again. A thumb depression on the surface of the bolt is provided to facilitate manual retraction of the bolt.

The original equipment ammunition magazine is retained, but the invention further includes a magazine insert that is insertable into a bottom end of the ammunition magazine and up against the follower of the magazine. The magazine insert receives and stores ammunition cartridges for calibers that correspond to the calibers of the barrel inserts that are to be used with the rifle. The magazine insert includes a case dimensioned for insertion into the ammunition magazine, a spring-loaded magazine follower housed within the case, and a cartridge keep at a bottom end of the magazine insert for retaining ammunition cartridges within the magazine insert.

Figure 1:
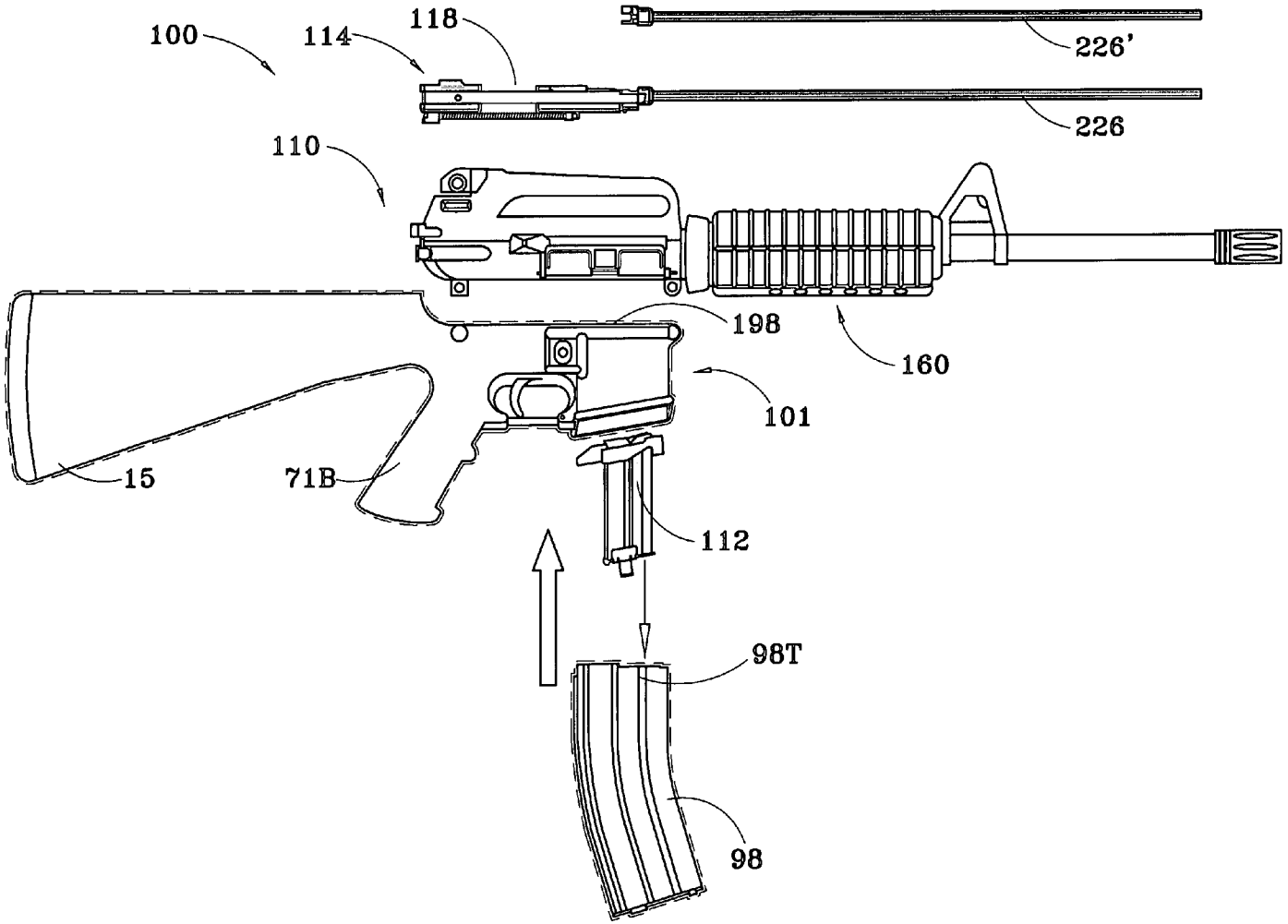
FIG. 1 is a right side elevational view of a caliber convertible upper receiver system for a magazine equipped, manually operated or semiautomatic or fully automatic firearm, wherein the system is depicted in solid lines and includes an upper receiver assembly, a combination first barrel insert and bolt adapter carrier assembly that is insertable into the upper receiver assembly and a second barrel insert, and the lower receiver portion of the firearm is shown in phantom outline.
Figure 13:
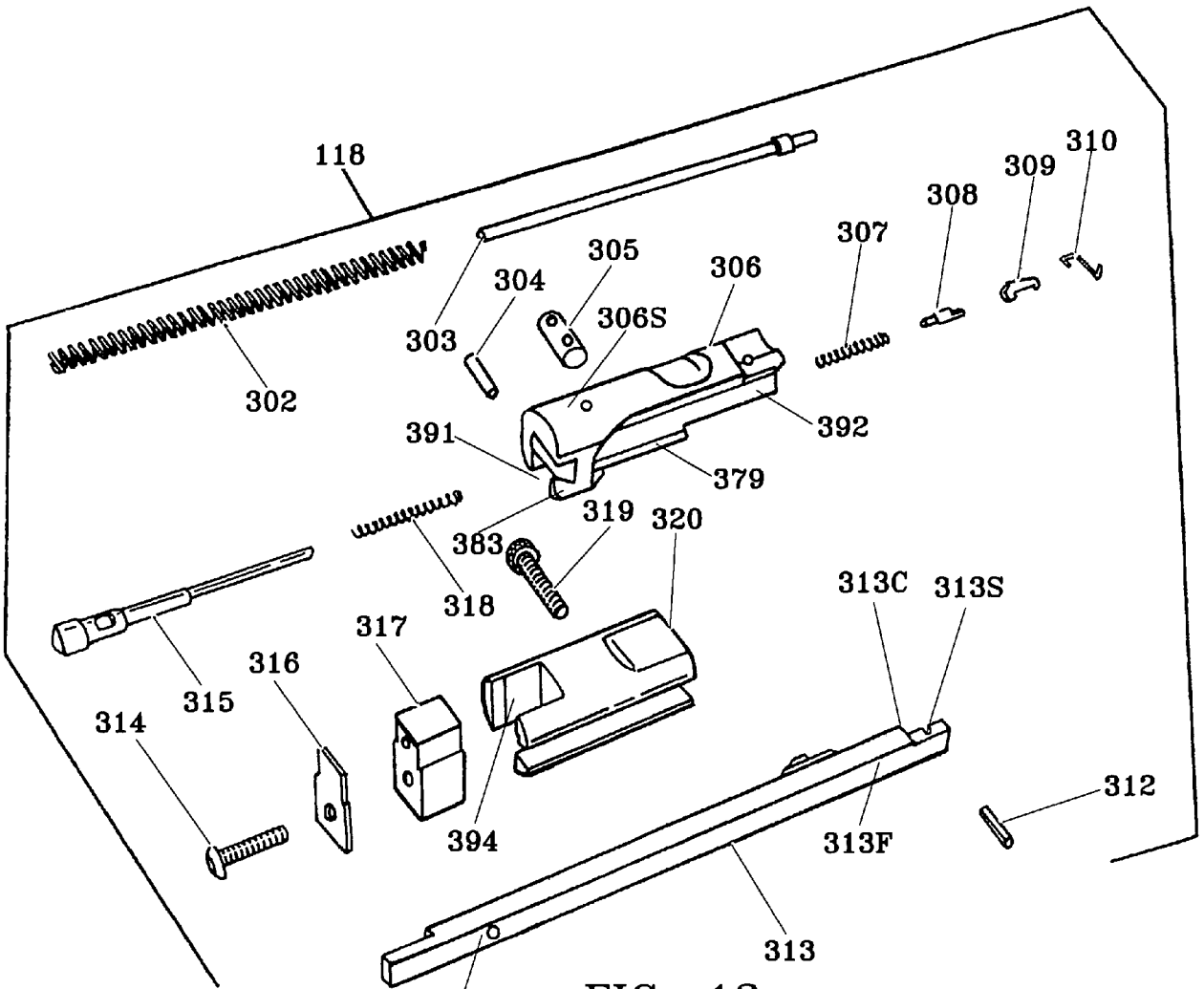
FIG. 13 is an exploded, perspective view of the bolt adapter carrier assembly as viewed from above.

As used herein, the terms "left," "right," "top," and "bottom" refer to the left, right, top and bottom portions, respectively, of the caliber convertible upper receiver system as they would appear to a marksman or trainee who is holding it against his body in a ready-to-aim-and-fire position. The terms "front" and "rear" refer to the right and left portions of the system, respectively, as depicted in FIGS. 1 and 13. Similar numerals denote similar components of the invention throughout the several figures.

DESCRIPTION OF THE PREFERRED EMBODIMENT

Referring to FIG. 1, the caliber convertible upper receiver system of the present invention, denoted generally by the numeral 100, is shown in solid outline and detached from, but along side of, an original equipment manufactured, prior art AR-15 lower receiver portion 101; the latter, together with an original equipment manufactured, prior art ammunition magazine 98 inserted into the magazine well of the lower receiver portion, are shown in phantom outline to emphasize that the lower receiver portion and ammunition magazine 98 are not constituent parts of the present invention. The system 100 comprises a barrel assembly 160 that attaches to a front end of an upper receiver portion 110, a bolt adapter carrier assembly 118 that attaches to a first barrel liner 226 to form a combination bolt adapter carrier assembly and barrel liner 114; a second barrel liner 226' that is also attachable to the bolt adapter carrier assembly 118 to form the combination 114 once the first barrel liner 226 has been removed therefrom; and a magazine adapter insert 112 that inserts into a lower end of the ammunition magazine 98. As described below, the first barrel liner 226 and the second barrel liner 226' are adapted for use with ammunition cartridges of two different calibers—the first barrel liner 226 for use with .17 caliber cartridges and the second barrel liner 226' for use with .22 caliber cartridges, for instance. Accordingly, the combination of the upper receiver portion 110, barrel assembly 160, lower receiver portion 101, bolt adapter carrier assembly 114, the first barrel liner 226, second barrel liner 226', magazine 98 and magazine insert 112 together comprise a modified AR-15 rifle that is capable of firing ammunition cartridges of differing calibers. To assemble the rifle combination, ready to aim and fire, one has only to slide the combination 114 into the upper receiver portion 110 and barrel assembly 160 in a manner described below, attach the upper receiver portion 110 to the lower receiver portion 101 by inserting the pivot pin 74 and the takedown pin 88 through apertures in the upper and lower receiver portions provided for that purpose, insert ammunition of the desired caliber into the magazine insert 112, and insert the magazine adapter insert 112 into the ammunition magazine 98.

Figure 2:
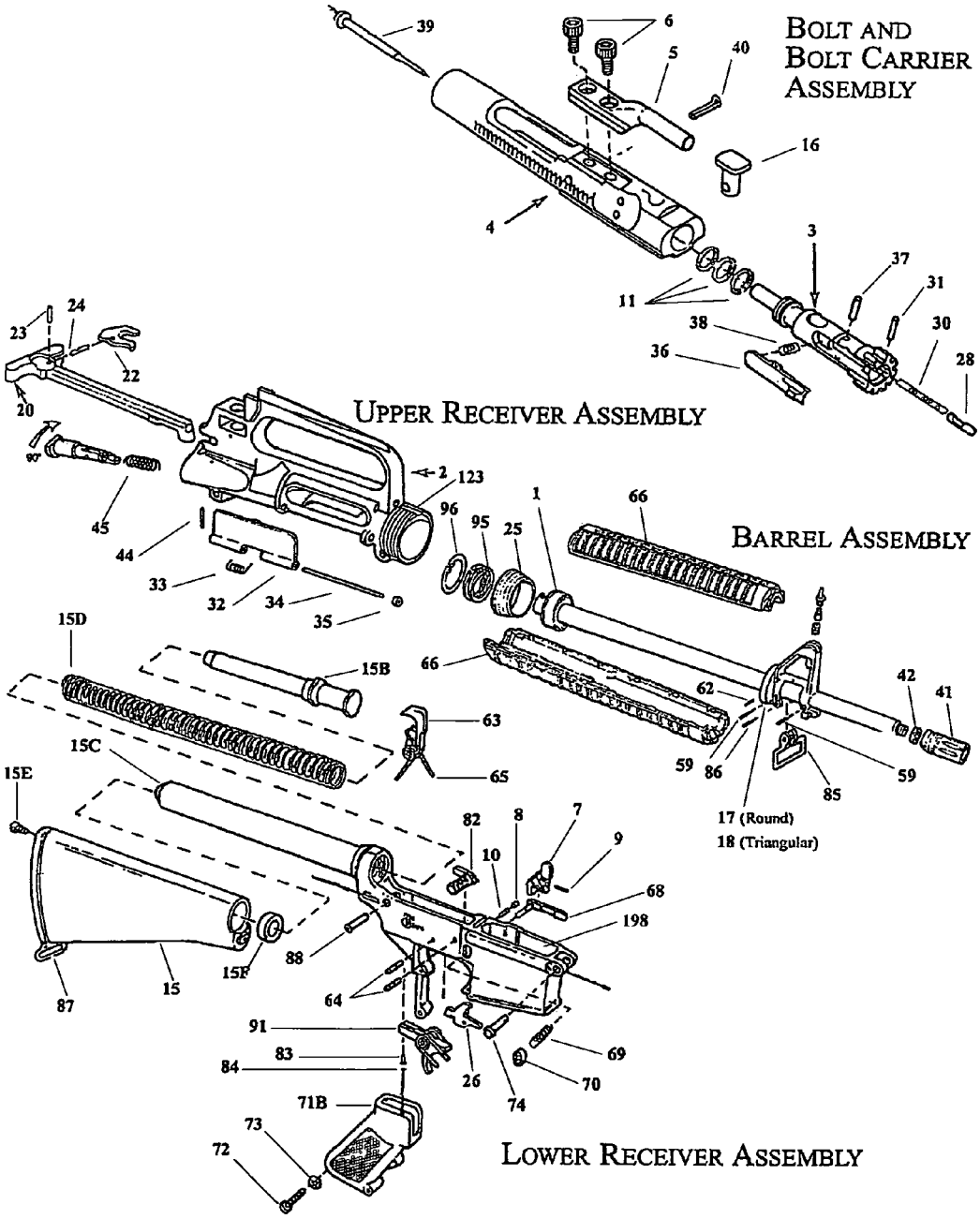
FIG. 2 (Prior Art)
FIG. 2 depicts in exploded view the bolt and carrier assembly, upper receiver assembly, barrel assembly and lower receiver assembly of an unmodified, prior art AR-15 rifle.

Referring to FIG. 2, an unmodified, prior art AR-15 rifle is shown in exploded, perspective view, comprising a bolt and bolt carrier assembly, an upper receiver assembly, a barrel assembly, and a lower receiver assembly. As depicted, this AR-15 rifle includes a blowback gas system to eject spent ammunition cartridges, and it is this version of the AR-15 that the herein-described embodiment of the invention converts for use with cartridges of dissimilar caliber. It will be understood, however, that the invention is not limited to conversion of only this version of the AR-15 rifle, as, from the disclosure herein, it will become obvious to persons of ordinary skill in the art how to convert other, similar semiautomatic and automatic rifles for use with cartridges of dissimilar caliber, including those of the gas tube variety. Of the assemblies depicted in FIG. 2, for the present invention the lower receiver assembly is retained, but the bolt and bolt carrier assembly and the barrel assembly are discarded and replaced with an adapter carrier assembly 114 and a new, modified barrel assembly 160. The upper receiver assembly is retained except for dimensional modifications to accommodate insertion therein of the adapter bolt carrier assembly 114 and barrel inserts 226 and 226'. For the sake of clarity and convenience, a list of the component parts of the unmodified, prior art AR-15 as depicted in FIG. 2 are recited hereafter.

Figure 3:
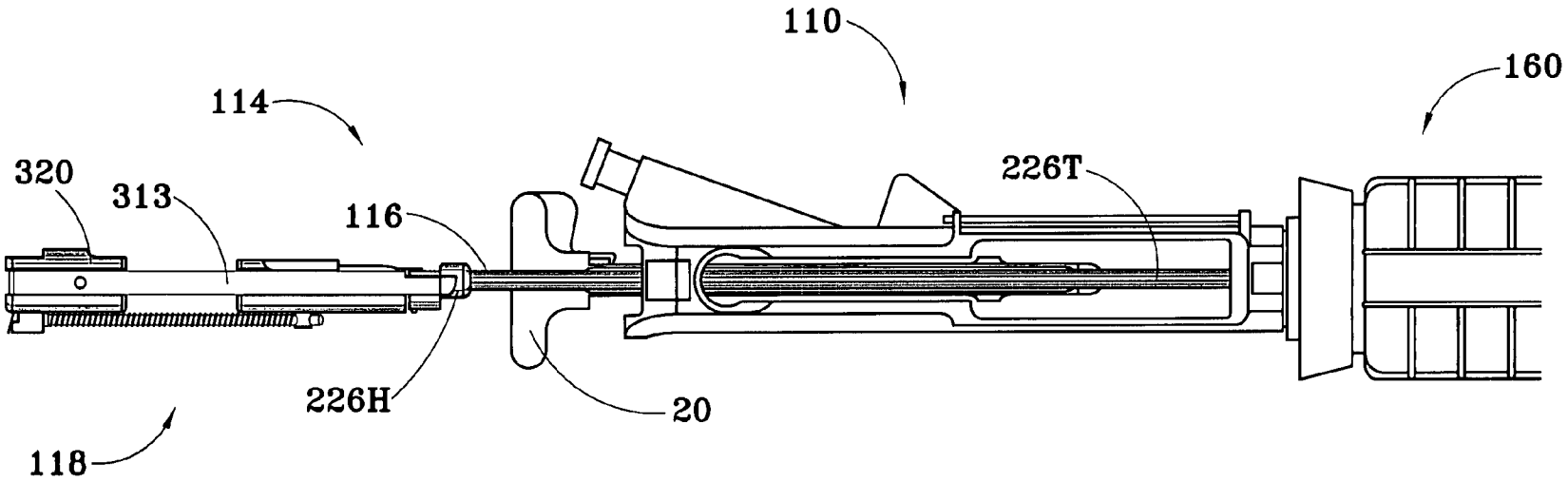
FIG. 3 is a rear perspective, bottom view of the upper receiver assembly and barrel assembly of the present invention, showing the charging handle and combination bolt adapter carrier assembly and first barrel insert partially withdrawn from the upper receiver assembly.
Figure 4:
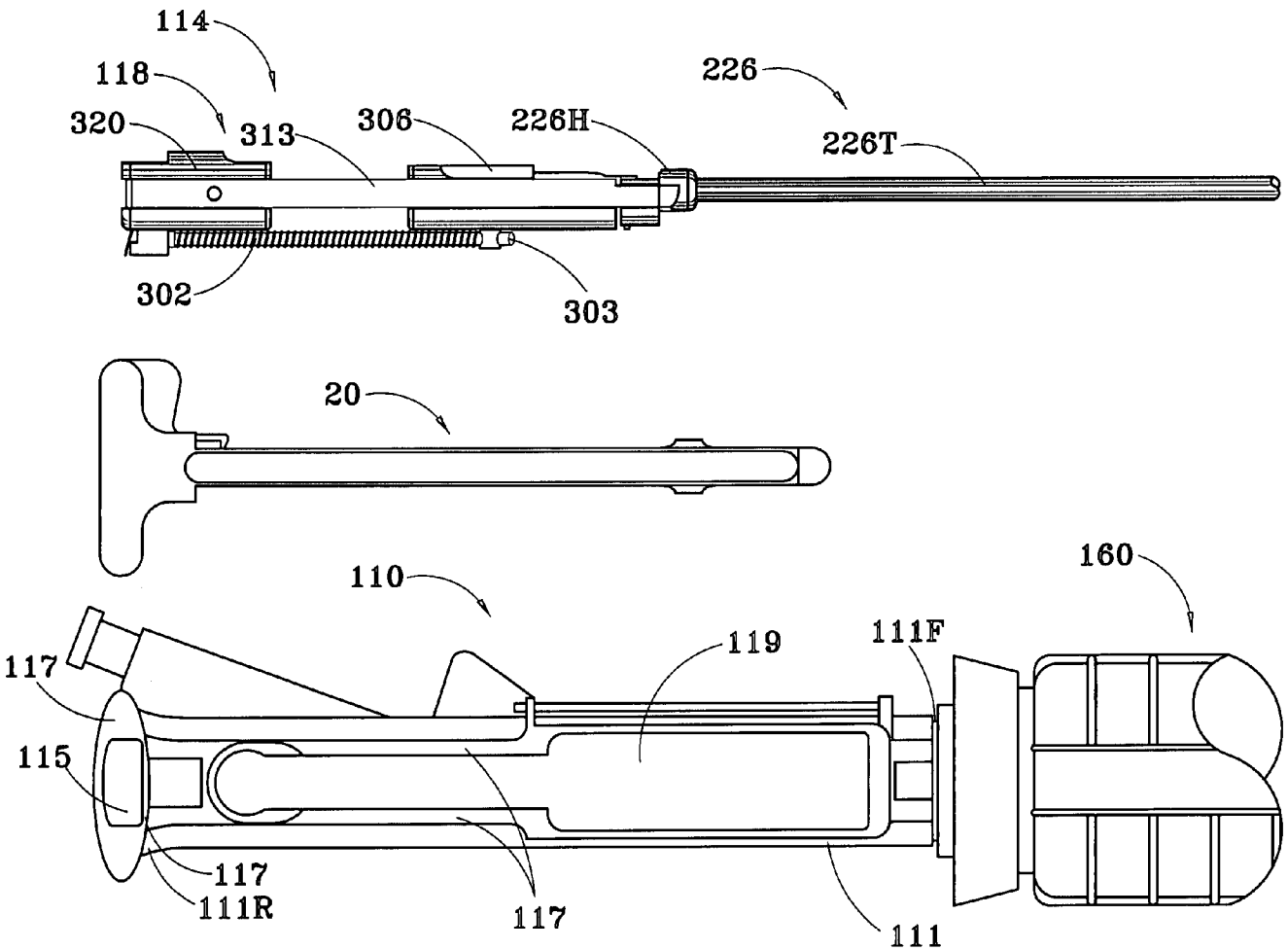
FIG. 4 is an enlarged, bottom perspective view of a rear portion of the upper receiver assembly, and of the combination bolt adapter carrier assembly and first barrel insert, after they and the charging handle have been fully withdrawn from the upper receiver portion.
Figure 5:
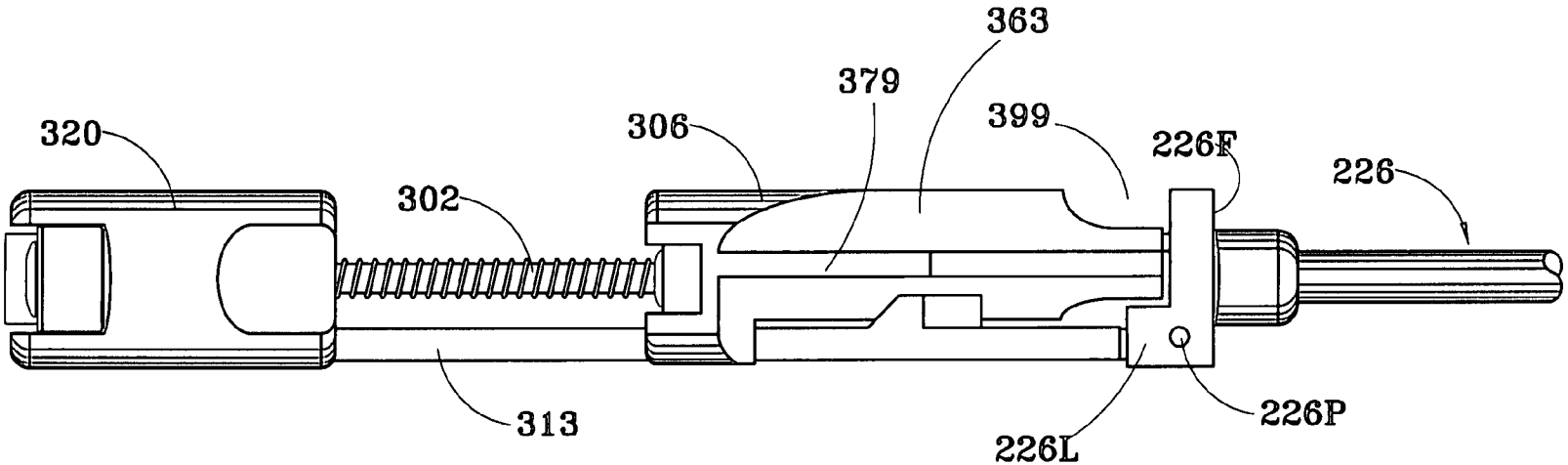
FIG. 5 is an enlarged, top view of the combination bolt adapter carrier assembly and first barrel insert fully withdrawn from the upper receiver assembly.
Figure 6:
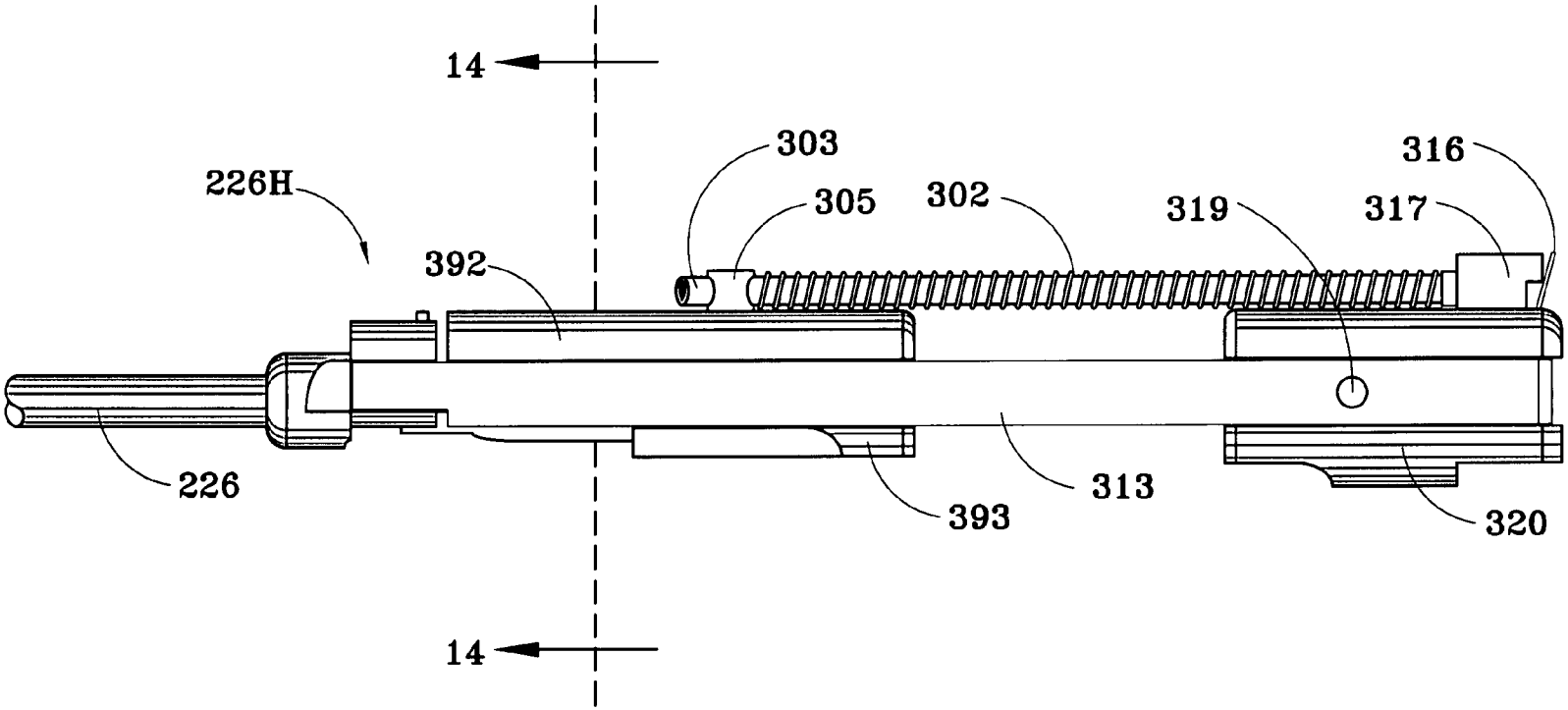
FIG. 6 is an enlarged left side view thereof.
Figure 7:
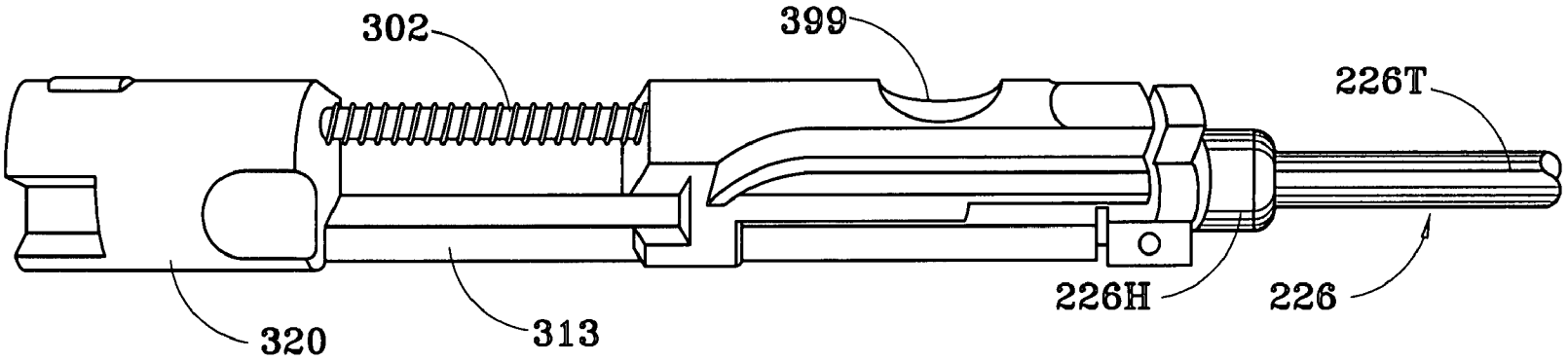
FIG. 7 is a further enlarged, perspective bottom view thereof.
Figure 8:
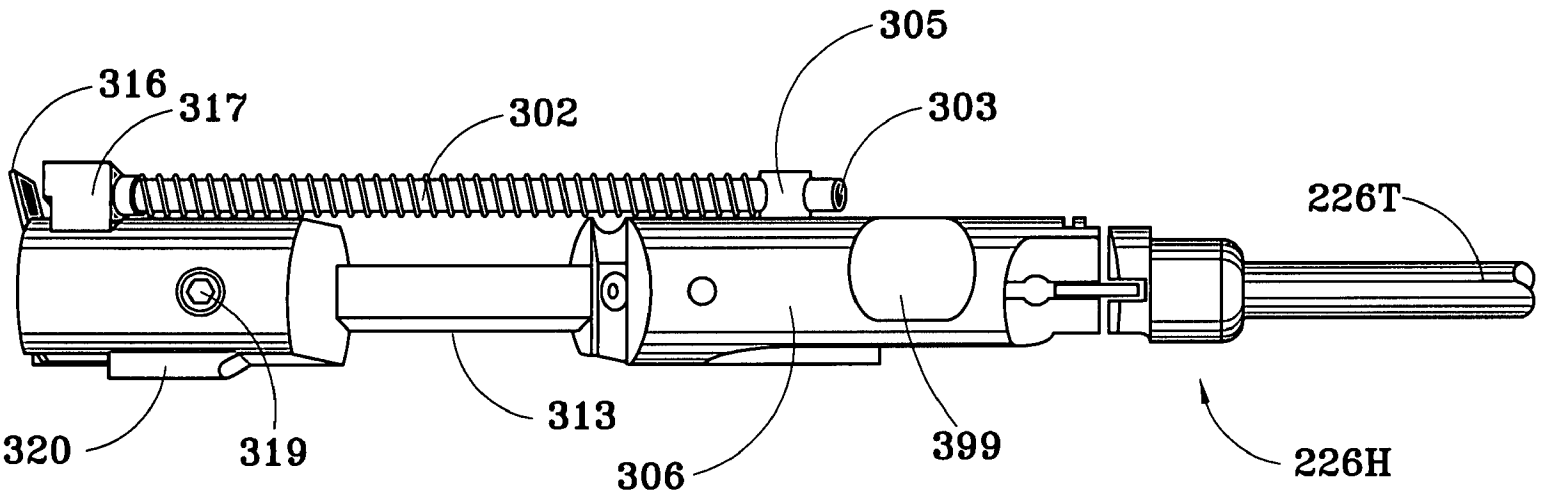
FIG. 8 is an enlarged right side view thereof.
Figure 9:
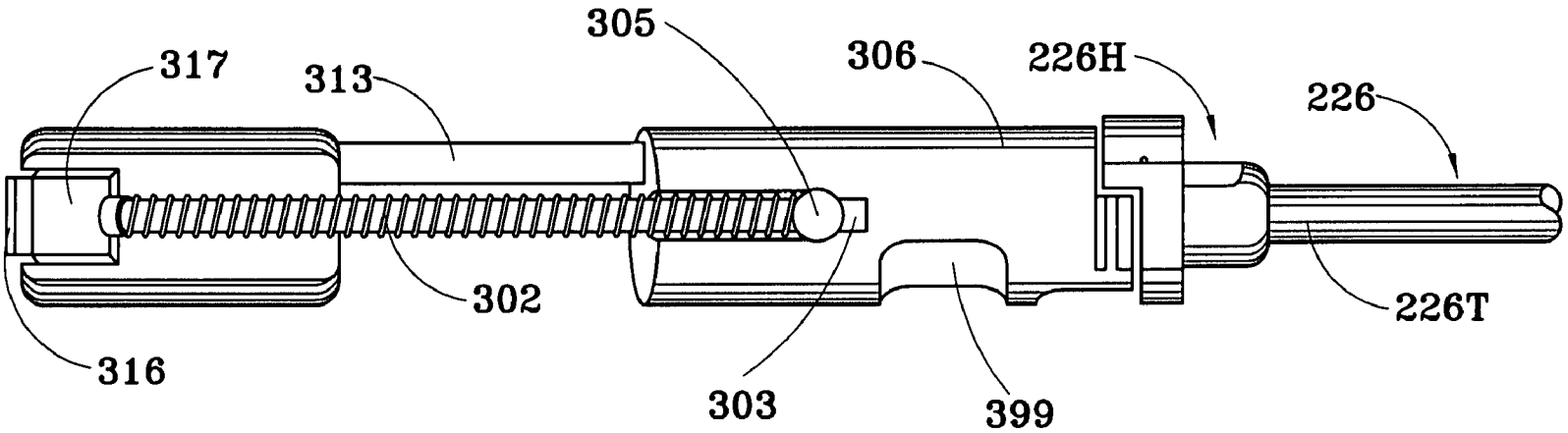
FIG. 9 is an enlarged top view thereof.

FIG. 3 shows the upper receiver portion 110 and barrel assembly 160 of the present invention, disattached from the lower receiver assembly 101 and inverted, and with its charging handle 20 partially withdrawn rearward out of the assembly 110. The combination 114 of the adapter bolt carrier assembly 118 and the first barrel insert 226 is also shown partially withdrawn from the upper receiver portion 110. FIG. 4 shows the charging handle 20 and the combination 114 both completely removed from the upper receiver portion 110. The upper receiver portion 110 includes an upper receiver 111 that extends longitudinally from a rear end 111R to a front end 111F and has a longitudinally-extended, upper channel 113 into which the charging handle 20 is insertable through a rear opening 115. The portion 110 further includes a pair of convexly curved side walls 117 that are coextensive with the channel portion 113 and depend therefrom, thereby defining a substantially cylindrical interior space 119, open at the bottom. At a front end of the portion 110 is a hollow, externally threaded, cylindrical extension 123, as may be seen in FIG. 2, which is coaxial and communicates with the interior space 119.

The barrel assembly 160 of the present invention is substantially identical to the barrel assembly of the prior art AR-15 as depicted in FIG. 2, except that, unlike the prior art AR-15, the barrel 3 has a smooth bore and is dimensioned to receive each of the inserts 226, 226'. As may be seen in FIG. 2, the barrel assembly 160 includes, in addition to the barrel 3 that extends from a first, firing chamber end 3F to an opposite second, muzzle end 3M, a pair of hand guards 66, means to attach the first end 3F to the upper receiver assembly, adjacent to and aligned with the firing chamber 198, a front sight 62 and a flash suppressor 41. Preferred means to attach the first end 3F to the upper receiver assembly are the barrel nut 1, delta ring 25, weld spring 95 and lock nut 96 mounted on the firing chamber end of the barrel 3 as shown in FIG. 2, wherein the delta ring 25 has internal, mating threads for threaded engagement of the external threads of the cylindrical extension 123.

Referring now to FIGS. 5-13, the first barrel liner 226 is dimensioned for insertion into the barrel bore and comprises a straight, longitudinally-elongated tube 226T and a head 226H at a rear, firing chamber end of the tube. The first barrel liner 226 is dimensioned for insertion into the barrel bore and to receive at its rear end a bullet fired from an ammunition cartridge of a first caliber and to conduct the bullet through the barrel assembly 160 and out an opposite, front end of the barrel liner. The second barrel liner 226' is identical to the first barrel liner 226, except that it is dimensioned for an ammunition cartridge of a different caliber. The head 226H has a longitudinally-directed aperture 226A for receiving a bullet fired from the firing chamber 198. The aperture 226A is coaxial and communicates with the bore of the tube 226T. The head 226H includes a pair of vertically spaced-apart legs 226L that extend rearward from a rear face 226F of the head on a first side of the head aperture 226A, as may best be seen in FIG. 11. A vertical liner engagement pin 226P is mounted between the legs 226L, as may best be seen in FIG. 12. The rear face 226F has a slot 226S disposed normal to the pin 226P on a second, opposite side of the aperture 226A.

Referring now to FIG. 13, the adapter bolt carrier assembly 118 is seen to include a bolt 306 that has a longitudinally-extended firing pin bore 377 which houses a firing pin 315. A firing pin spring 318 in the form of a coil spring is mounted on the firing pin 315 and disposed inside the firing pin bore 377, such that each time a hammer 63, located within the lower receiver portion 101, impacts a rear end 315R of the firing pin 315 after the trigger 91 has been pulled, the firing pin is driven forward by the impact and a front portion thereof extends out of a front portion of the firing pin bore 377 to impact the rim of any ammunition cartridge within the firing chamber 198, thereby firing the cartridge and ejecting a bullet from the firing chamber into the barrel liner 226; thereafter, the firing pin spring 318 urges the firing pin 315 back to its original, retracted position, ready to receive the next blow of the hammer 63. Mounted within a front portion of the bolt 306 are an extractor plunger 308, an extractor 309 and a cartridge retainer 310 that are spring-loaded by an extractor spring 307; these components serve to eject a spent cartridge from the firing chamber 198 in the same manner in which they perform that task in an original-equipment, unmodified AR-15 rifle. The extractor 309 extends into the slot 226S of the liner head 226H whenever the bolt 306 is pressed against the liner head. For conversion of an AR-15 rifle between .17 caliber and .22 caliber ammunition, barrel liner dimensions should be as follows: for a .22 caliber barrel liner, liner length 41 cm, liner tube outer diameter 7.918 mm, and liner tube inner diameter 5.608 mm; for a .17 caliber barrel liner, liner length 41 cm, tube inner diameter 7.918 mm, and liner inner diameter 4.3653 mm.

Figure 14:
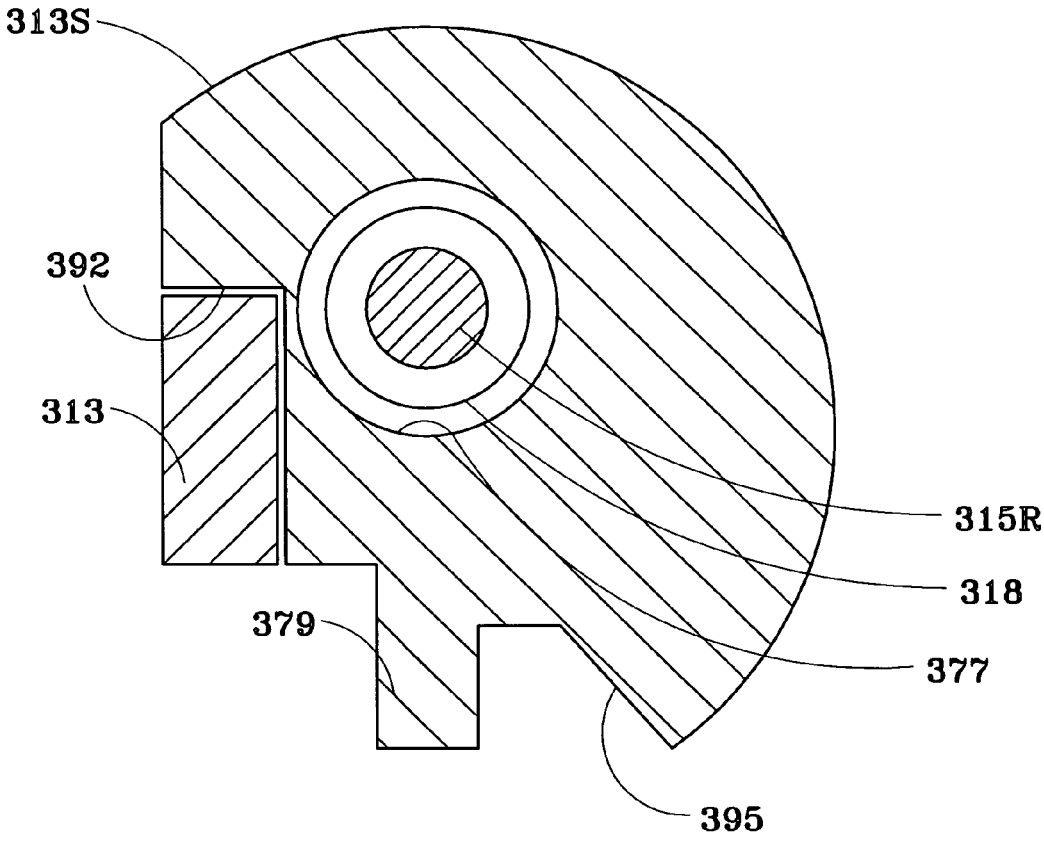
FIG. 14 is a vertical cross-sectional view of the adapter bolt carrier assembly taken along line 14-14 of FIG. 6.

The adapter bolt carrier assembly 118 further includes means for attaching and disattaching alternately the head 226H, 226H' of the first or the second barrel liner 226, 226', respectively, to the adapter bolt carrier assembly. Such means includes a straight, rail guide 313 that extends longitudinally from a rear end 313R to an opposite, front end 313F, and a support rail 320 fixedly mounted by a socket head cap screw 319 to the rear end 313R of the guide rail 313 and extending part way toward the front end 313F of the guide rail. The bolt 306 is slidably mounted on the guide rail 313 for movement between the support rail 320 and the front end 313F of the guide rail. Such means further includes spring means for urging the bolt 306 away from the support rail 320. The upper half of the bolt 306 has a semicylindrical surface 306S. In the preferred embodiment, the spring means includes an apertured, front lug 305 inserted into a recess (not shown) on the cylindrical surface 306S of the bolt 306, an apertured rear lug 317 mounted to the support rail 320, a straight, spring support pin 303 disposed parallel to the guide rail 313, and a coil spring 302 mounted on the spring support pin between the front lug 305 and the rear lug 317. The rear lug 317 is mounted within a recess 394 of the support rail 320 by a position spring 316 and position spring retaining screw 314. The spring support pin 303 is inserted through aligned apertures in the front and rear lugs 307, 317. From the support rail 320 and forward along about nine-tenths of its length, the guide rail 313 is rectangular in vertical cross-section; correspondingly, a left portion of the bolt 306 has a longitudinally-extended, rectangular recess 391 for mating and sliding engagement with the guide rail 313, which recess 391 is defined by a straight, flat, horizontal, rail guide engaging surface 392 that forms a lower, left margin to the semicylindrical, upper surface 306S of the bolt 306, and which recess 391 is further defined by a vertical, longitudinally—extended wall 393 and an ear 383 that extends rightward and parallel to the surface 392 at a rear end of the bolt 306, as best seen in FIGS. 13 and 14. The bolt 306 also has a straight, lower, right margin 395 to the semicylindrical, upper surface 306S that, except for a rear end portion thereof, is canted inwardly and upwardly. The rear half of the bolt 306 further includes a straight, longitudinally-extended feeding ramp 379 that is parallel to the firing pin bore 377 and extends downward therefrom. The feeding ramp 379 strips the cartridge from the magazine 98. The bolt 306 has a contoured bottom surface 363 that overlies the firing chamber 198 when the rifle is fired. The lower half of the remaining, approximately one-tenth, of the length of the guide rail 313 is cut away 313C, thereby forming a tongue extension 396 to the guide rail 313 at a front end thereof, to receive one of the legs 226L of a liner head 226 attached to the adapter bolt carrier assembly 118. The cutaway portion 313C has a vertical slot 313S to receive the liner engagement pin 226P of a liner head 226H, 226H'.

Figure 10:
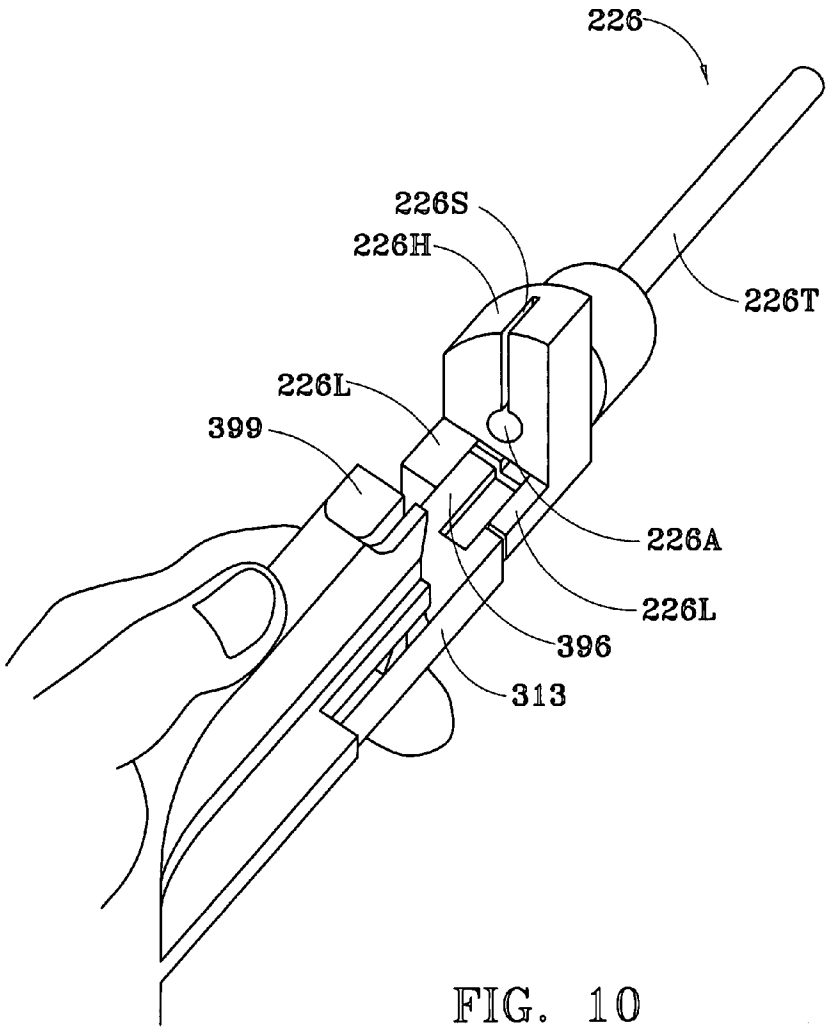
FIG. 10 is an enlarged, rear perspective view of the right side thereof, showing the bolt pulled away from the head of the barrel insert preparatory to removing the insert head from the bolt adapter carrier assembly.
Figure 11:
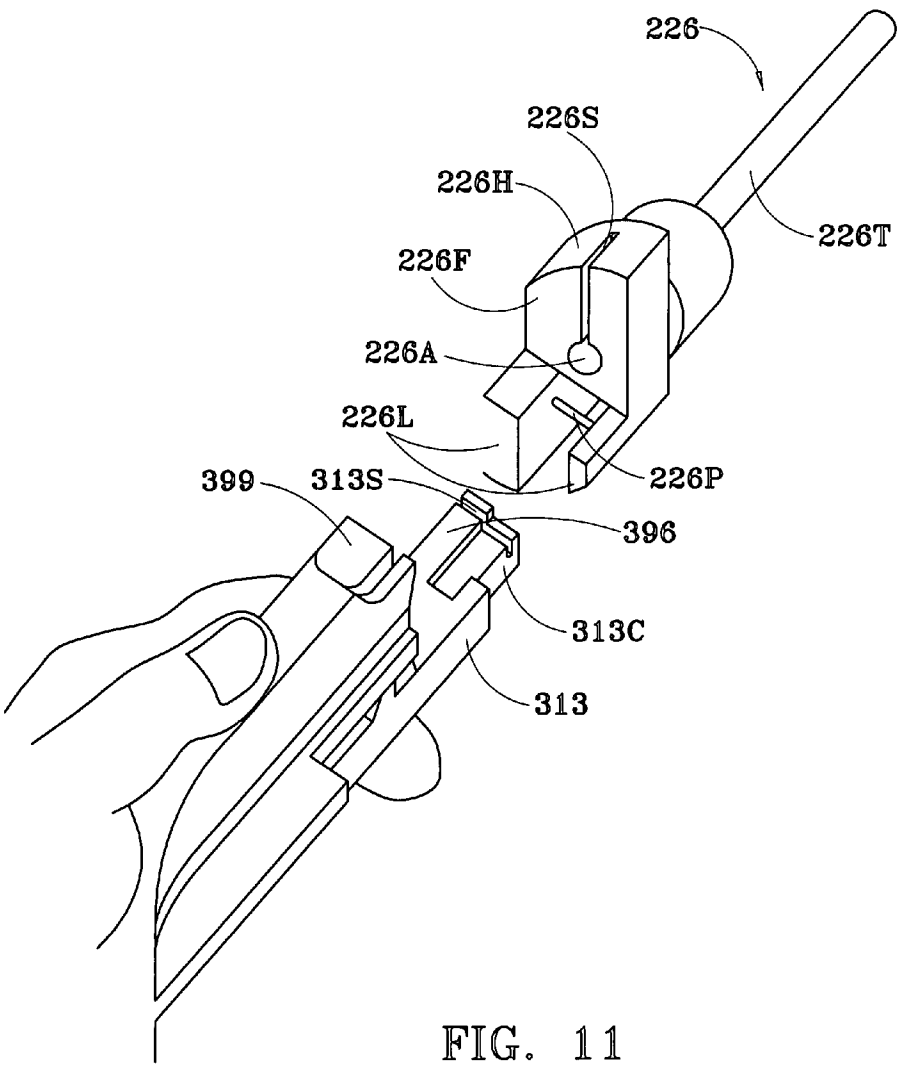
FIG. 11 is an enlarged perspective of the right side thereof, showing the insert head removed from the bolt adapter carrier assembly.
Figure 12:
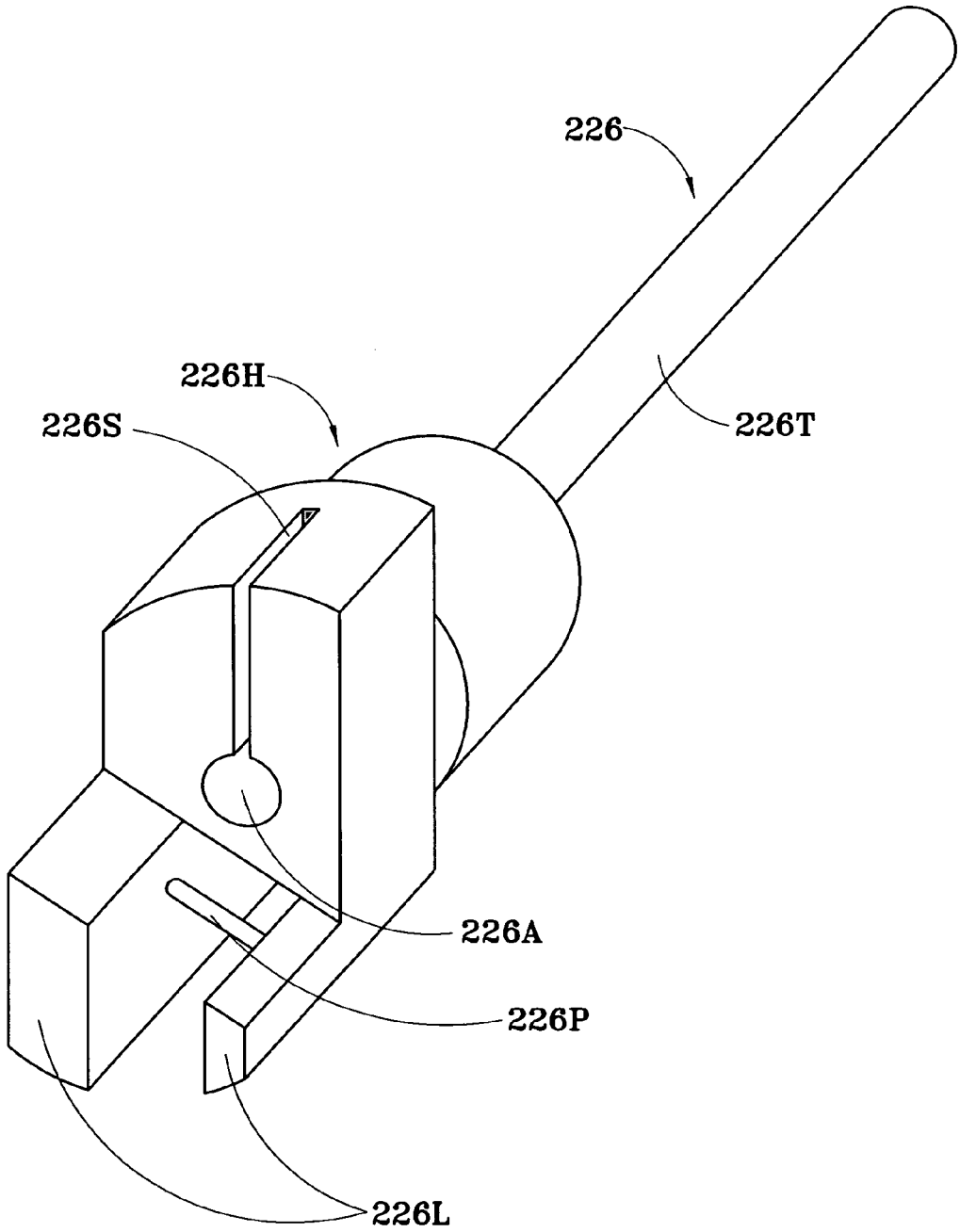
FIG. 12 is an enlarged, right side view of the first barrel liner after its removal from the bolt adapter carrier assembly.

A right aspect of the semicylindrical surface 306S of the bolt 306 is recessed to form a thumb depression 399 in order to facilitate manual retraction of the bolt while attaching the head 226H of a barrel liner 226 to, or while disengaging the head of a barrel liner from, the bolt adapter carrier assembly 118. In use, to disattach a barrel liner 226 from the bolt carrier assembly 118, the upper receiver portion and barrel assembly are removed from the lower receiver portion, the charging handle 20 is withdrawn from the upper receiver portion 110, and the combination adapter bolt carrier assembly and barrel liner 114 is withdrawn from the rifle and the rotated axially 90 degrees counter-clockwise so that the thumb depression 399 will be on top. A thumb of one hand is placed over the thumb depression 399 while the barrel liner 226 is held with the opposite hand and the bolt 306 is retracted rearward, thereby compressing the spring 102; FIG. 10. While still firmly holding the bolt 306 retracted, the barrel liner head 226H is lifted up and away from the cutaway 313C of the rail guide 313 (FIG. 11) so that the transverse pin 226P (FIG. 12) is removed from the slot 313S of the rail guide 313. A head 226H' of a barrel liner 226' of a different caliber can then be attached to the adapter bolt carrier assembly 118 by inserting its liner engagement pin 226P' (not shown) into the slot 313S of the rail guide 313 and releasing the bolt 306 to slide forward to engage the liner head 226H'. The combination 114 is then rotated axially 90 degrees clockwise and slid into the upper receiver portion 110 and barrel assembly 160; then the upper receiver portion is reattached to the lower receiver portion. Once ammunition cartridges of a different caliber for use with the alternate barrel liner 226' have been loaded into the magazine adapter 112 and the magazine adapter has been inserted into the magazine 98, the rifle is ready for use again.

Figure 15:
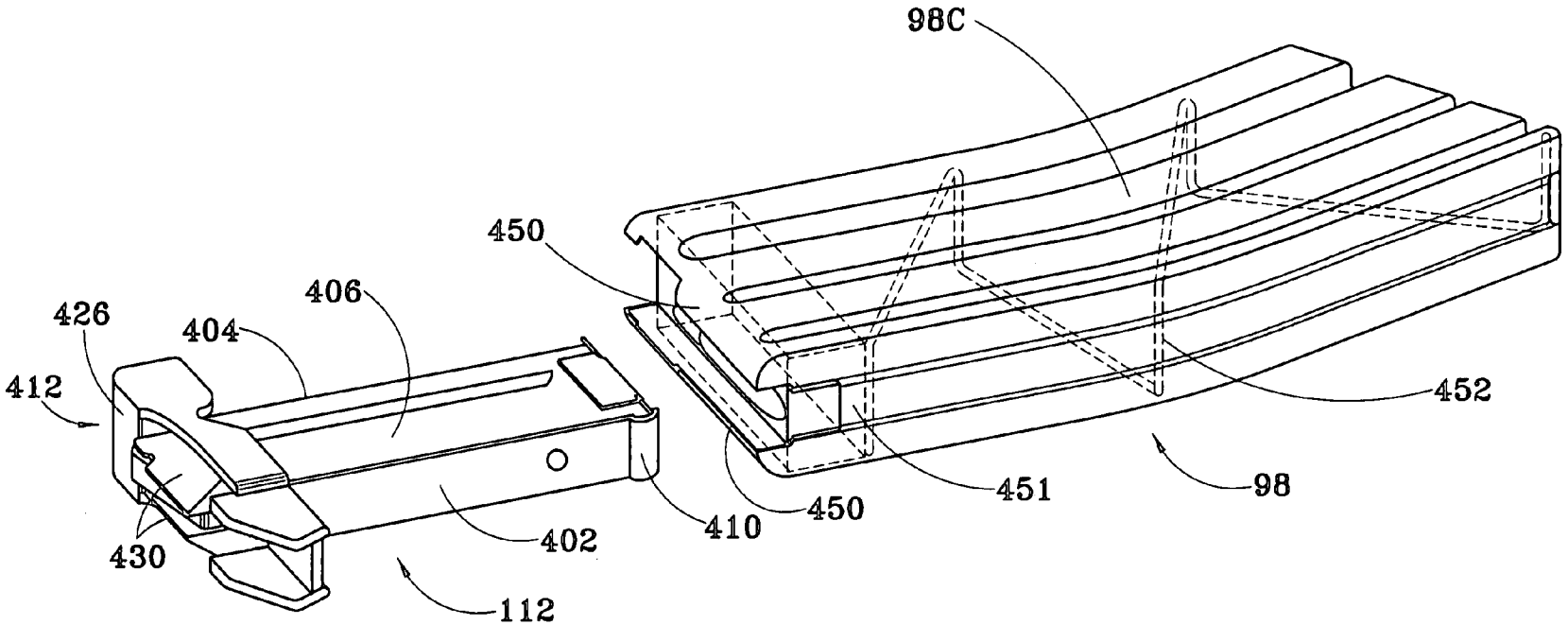
FIG. 15 is right, frontal perspective view of an original equipment ammunition magazine and the magazine insert of the present invention aligned for insertion into the ammunition magazine.
Figure 16B:
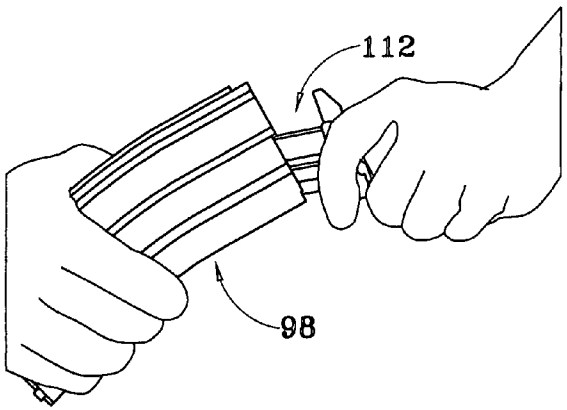
FIGS. 16A, 16B, 16C and 16D depict the steps for inserting the magazine insert into the magazine.
Figure 16D:
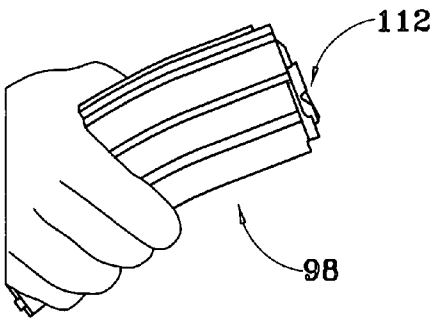
Figure 16A:
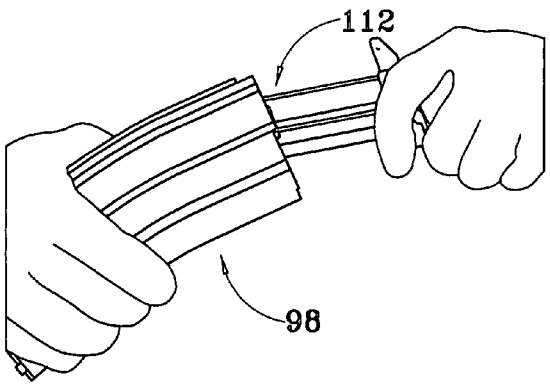
Figure 16C:
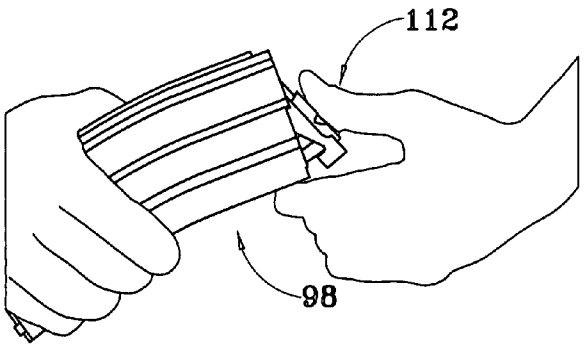
Figure 17:
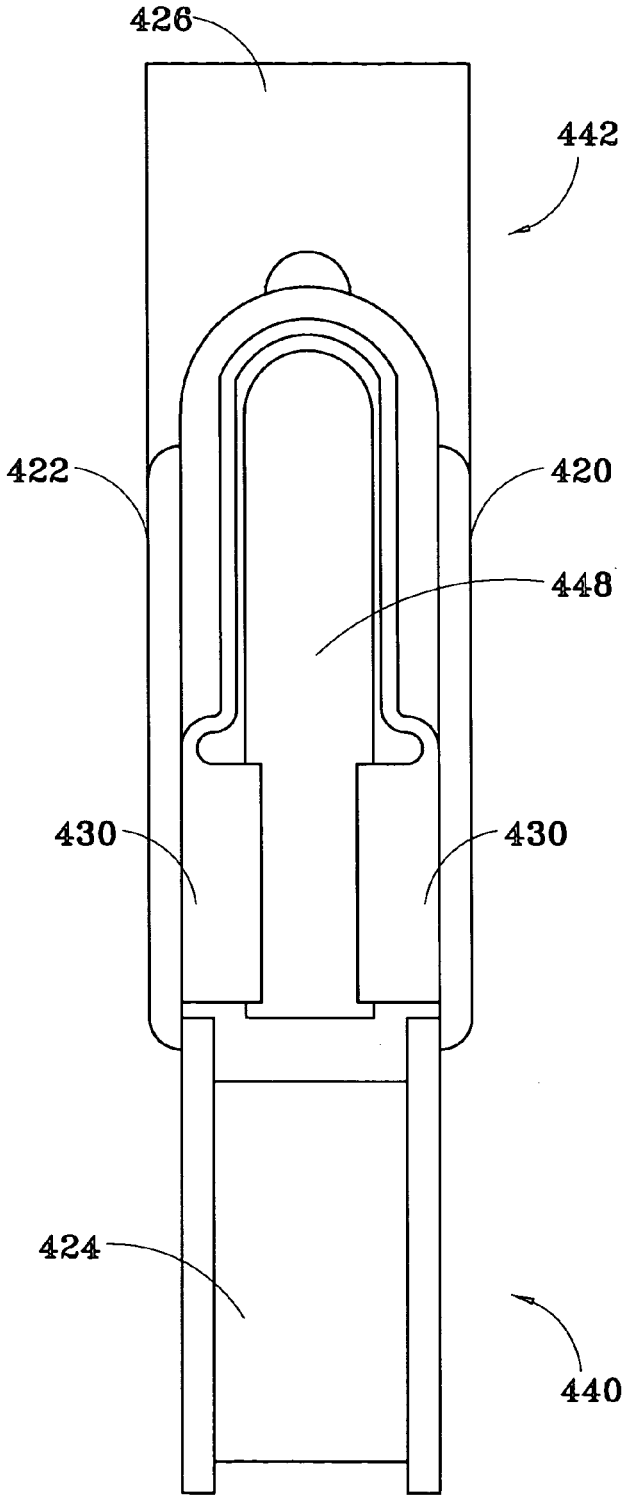
FIG. 17 is a bottom view of the magazine insert.

FIGS. 16A-16D show how the magazine adapter insert 112 is inserted into a top end 98T of an ammunition magazine 98. Internally, the magazine adapter insert 112 is constructed in a manner similar to the internal components of the ammunition magazine 98 and includes a spring-loaded magazine follower, comprising a follower head 451 and a follower spring as shown in phantom outline in FIG. 15. The dimensions of the internal components of the magazine adapter insert 112 are smaller than the similar internal components of the magazine 98, however, such that a magazine adapter insert 112 for insertion into a 30 cartridge capacity magazine 98 will hold only about 10 cartridges of caliber .17 or .22. The magazine adapter insert 112 has a flat front wall 402 and a semicylindrical rear wall joined by a left wall 406, a right wall 408 that is shaped as a mirror image of the left wall 406, and a bottom wall 410, which defines a closed space that is open at a top end thereof. A spring-loaded magazine adapter follower 448 is disposed within the closed space. An upper portion of the follower is retractable into the closed space against the urging of a follower spring when an ammunition cartridge is manually pressed up against a top end of the follower. As may best be seen in FIG. 17, the magazine adapter insert 112 further includes a cartridge keep at the top end thereof, denoted generally by the numeral 412, for temporarily holding an ammunition cartridge preparatory to its being fired within the firing chamber. The keep 412 includes a left wall 420 and a right wall 422 attached to an upper end of the left and right walls 406, 408 of the magazine adapter insert 112, respectively. The left wall 420 and right wall 422 extend outward as a front extension 440 and a rear extension 442 of the cartridge keep left and right walls 406, 408. The keep 412 further includes a front, top wall 424 and a rear, top wall 426 that join the front and rear extensions 420, 422. A pair of cartridge retainer tabs 430 extend upward and inward from the left and right walls 420, 422 of the keep 412. The ammunition magazine 98 comprises a case 98C with an open, top end, that has a pair of inward-directed retainer tab extensions 450 that extend up from the top end. The magazine adapter insert 112 is dimensioned for insertion into the open, top end of the ammunition magazine 98, down against the follower of the magazine 112 as far as it will go, followed by locking the keep 412 into fixed position within the tab extensions 450.

From the foregoing description, it will be clear that the present invention may be embodied in other specific forms without departing from the spirit or essential characteristics thereof. Thus, the presently disclosed embodiments are therefore to be considered in all respects as illustrative and not restrictive, the scope of the invention being indicated by the appended claims, and not limited to the foregoing description.

| Part # | Part Name |
|---|---|
| 1 | barrel nut |
| 2 | upper receiver, stripped |
| 3 | bolt |
| 4 | bolt carrier |
| 5 | bolt carrier key |
| 6 | bolt carrier key screw |
| 7 | bolt catch |
| 8 | bolt catch plunger |
| 9 | bolt catch roll pin |
| 10 | bolt catch spring |
| 11 | bolt gas rings, set |
| 12 | buffer detent |
| 13 | buffer detent spring |
| 15 | butt stock |
| 15B | butt stock buffer |
| 15C | receiver extension |
| 15D | buffer spring |
| 15E | butt stock screw |
| 15F | stock spacer |
| 16 | cam pin |
| 17 | cap handguard front (round) |
| 18 | cap handguard front (triangular) |
| 20 | charging handle |
| 22 | charging handle latch |
| 23 | charging handle latch roll pin |
| 24 | charging handle latch spring |
| 25 | delta ring |
| 26 | disconnector |
| 27 | disconnector spring |
| 28 | ejector |
| 30 | ejector spring |
| 31 | ejector roll pin |
| 32 | ejection cover |
| 33 | ejection cover spring |

-continued

| Part # | Part Name |
|---|---|
| 34 | ejection cover hinge plate |
| 35 | ejection cover hinge pin clip |
| 36 | extractor |
| 37 | extractor pin |
| 38 | extractor spring with insert |
| 39 | firing pin |
| 40 | firing pin retaining pin |
| 41 | flash suppressor |
| 42 | flash suppressor lock washer |
| 44 | forward assist retainer pin |
| 45 | forward assist spring |
| 63 | hammer |
| 64 | hammer and trigger pin |
| 65 | hammer spring |
| 66 | handguards |
| 68 | magazine catch |
| 69 | magazine catch spring |
| 70 | magazine catch button |
| 71B | pistol grip |
| 72 | pistol grip screw |
| 73 | pistol grip screw washer |
| 74 | pivot pin, front |
| 82 | safety selector |
| 88 | takedown pin |
| 83 | safety detent |
| 84 | safety spring |
| 85 | swivel, front |
| 86 | swivel pin |
| 87 | swivel, rear |
| 88 | takedown pin, rear |
| 91 | trigger |
| 95 | weld spring |
| 96 | lock ring |
| 98 | ammunition magazine |
| 100 | caliber convertible upper receiver system |
| 101 | lower receiver portion |
| 110 | upper receiver portion |
| 111 | upper receiver, modified |
| 112 | magazine adapter insert |
| 114 | combination bolt adapter carrier assembly and barrel liner |
| 118 | bolt adapter carrier assembly |
| 123 | upper receiver cylindrical extension |
| 160 | barrel assembly |
| 226 | first barrel liner |
| 226' | second barrel liner |
| 302 | coil spring |
| 303 | spring support pin |
| 305 | apertured front lug |
| 306 | bolt |
| 307 | extractor spring |
| 308 | extractor plunger |
| 309 | extractor |
| 310 | cartridge retainer |
| 313 | rail guide |
| 314 | position spring retaining screw |
| 315 | firing pin |
| 316 | position spring |
| 317 | apertured rear lug |
| 318 | firing pin spring |
| 319 | socket head cap screw |
| 320 | support rail |
| 412 | cartridge keep |
| 430 | cartridge retainer tabs |
| 448 | follower of magazine adapter insert |
| 450 | retainer tab extensions |

I claim:

1. A caliber convertible, upper receiver system for a magazine-equipped, manually operated or semiautomatic or fully automatic firearm, said upper receiver system being adapted to replace the original equipment upper receiver portion and to attach to the original equipment lower receiver portion of said firearm in order to render the firearm capable of firing either a first cartridge or a second cartridge, the first and second cartridges having dissimilar calibers, the system comprising:

an upper receiver assembly attachable to the lower receiver portion of the firearm, said assembly including a charging handle; and an upper receiver extending longitudinally from a rear end to a front end and having a longitudinally-extended, upper channel portion into which the charging handle is insertable through a rear opening thereof and a pair of side walls coextensive with the channel portion and depending therefrom that define a substantially cylindrical interior space, open at the bottom, and an externally threaded, cylindrical extension at a front end of the upper receiver that is coaxial with said interior space;

a barrel assembly extending longitudinally from a rear, firing chamber end to an opposite, front end, said barrel assembly including a barrel having a straight, cylindrical bore; and means to attach said rear end to the upper receiver assembly, adjacent to and aligned with the firing chamber;

a first barrel liner dimensioned for insertion into the barrel bore and to receive at a rear, firing chamber end thereof a bullet fired from the first cartridge in the firing chamber, and to conduct the bullet through the barrel assembly and out an opposite, front end of said barrel liner, said first barrel liner including a first barrel liner head at the rear end of said liner, said head having a longitudinally-directed aperture for receiving a bullet fired from the firing chamber, and a first liner tube that extends longitudinally from said head to the front end of the first liner, said tube having a bore aligned with the aperture of said head;

a second barrel liner dimensioned for insertion into the barrel bore and to receive at a rear, firing chamber end thereof a bullet fired from the second cartridge in the firing chamber, and to conduct the bullet through the barrel assembly and out an opposite, front end of said barrel liner, said second barrel liner including a second barrel liner head at the rear end of said liner, said head having a longitudinally-directed aperture for receiving a bullet fired from the firing chamber, and a second liner tube that extends longitudinally from said head to the second end of the second liner, said tube having a bore aligned with the aperture of said head;

a bolt adapter carrier assembly insertable into the cylindrical interior space of the lower receiver, said assembly including a bolt that carries a spring-loaded firing pin mounted for reciprocal, longitudinal movement within a firing pin bore of the bolt, and means for attaching and disattaching alternately the head of either the first or the second barrel liner to said carrier assembly; and a magazine adapter insert dimensioned for insertion and retention within the magazine of the firearm and adapted to receive and store a plurality of the first or second cartridges for use as ammunition by the firearm.

2. The system of claim 1, wherein the head of each of the liners includes a pair of spaced-apart legs, a liner engagement pin mounted between the legs on a first side of the head aperture, and a first slot disposed normal to the pin on an opposite side of the head aperture; and the means for attaching and disattaching the head from the bolt adapter carrier assembly includes a rail guide that extends longitudinally from a rear end to an opposite, front end, said front end having a tongue extension with a second slot for receiving the liner engagement pin, and said tongue extension being cut out on one side to receive one of the legs of a liner head and to permit the other leg to be placed adjacent to the tongue extension in side by side relation so that the legs straddle the tongue extension;

a support rail fixedly mounted to the rear end of the guide rail and extending part way toward the front end of the support rail;

wherein said bolt is slidably mounted on the guide rail for movement between the support rail and the front end of the guide rail, and spring means for urging the bolt away from the support rail and into engagement with the head of a liner.

3. The system of claim 2, wherein the spring means includes an apertured, rear lug mounted to the support rail;

an apertured, front lug mounted to the bolt;

a spring support pin disposed parallel to the guide rail and having a rear end inserted into the apertured first lug and an opposite, front end inserted into the apertured, second lug; and a coil spring mounted on the spring support pin between the first lug and the second lug.

4. The system of claim 3, wherein an exterior surface portion of the bolt is recessed to form a thumb depression in order to facilitate manual retraction of the bolt while attaching the head of a barrel liner to, or disengaging the head of a barrel liner from, the bolt adapter carrier assembly.

5. The system of claim 4, wherein the barrel assembly further comprises a front sight mounted on a forward portion of the barrel, upper and lower hand guards mounted on an exterior surface of the barrel, and a barrel extension that is coaxial with the barrel and extends from the barrel into the threaded cylindrical extension of the upper receiver.

6. The system of claim 5, wherein the first cartridge is a .22 caliber, rim-fire cartridge and the second cartridge is a .17 caliber, rim-fire cartridge.

7. The system of claim 6, wherein the term "firearm" refers to an AR-15.

8. The system as in any one of claims 1-7, wherein the magazine adapter insert includes a front wall and a rear wall joined by left and right side walls and a bottom wall, thereby defining a closed space that is open at a top end thereof;

a spring-loaded follower disposed within said closed space, an upper portion of said follower being retractable into said closed space against the urging of a follower spring when a cartridge is manually pressed down against an upper end of the follower;

and a cartridge keep including left and right walls attached to an upper end of the left and right walls of the insert, respectively, which left and right walls extend outward as front and rear extensions of said cartridge keep left and right walls, and front and rear top walls that join said front and rear extensions, and a pair of cartridge retainer tabs that extend upward from the left and right walls of the keep;

wherein the insert is dimensioned for insertion into an open, upper end of an ammunition magazine by pressing the bottom wall of the insert up against the follower of the magazine as far as it will go and locking the keep into a fixed position within inwardly-directed tab extensions that extend from an upper end of a standard, original equipment ammunition magazine.

9. For use in a caliber convertible, magazine-equipped, manually operated or semiautomatic or fully automatic firearm capable of firing either a first cartridge or a second cartridge through a barrel bore of the firearm, the first and second cartridges having dissimilar calibers, and the firearm including an upper receiver portion and a lower receiver portion, the combination of a bolt adapter carrier assembly and first and second barrel liners, comprising:

a first barrel liner dimensioned for insertion into the barrel bore and to receive at a rear, firing chamber end thereof a bullet fired from the first cartridge in the firing chamber, and to conduct the bullet through the barrel assembly and out an opposite, front end of said barrel liner, said first barrel liner including a first barrel liner head at the rear end of said liner, said head having a longitudinally-directed aperture for receiving a bullet fired from the firing chamber, and a first liner tube that extends longitudinally from said head to the front end of the first liner, said tube having a bore aligned with the aperture of said head;

a second barrel liner dimensioned for insertion into the barrel bore and to receive at a rear, firing chamber end thereof a bullet fired from the second cartridge in the firing chamber, and to conduct the bullet through the barrel assembly and out an opposite, front end of said barrel liner, said second barrel liner including a second barrel liner head at the rear end of said liner, said head having a longitudinally-directed aperture for receiving a bullet fired from the firing chamber, and a second liner tube that extends longitudinally from said head to the front end of the second liner, said tube having a bore aligned with the aperture of said head; and a bolt adapter carrier assembly for insertion into the interior space of the lower receiver, said assembly including means for attaching and disattaching alternately the head of either the first or the second barrel liner to said carrier assembly.

10. The combination of claim 9, wherein the head of each of the liners includes a pair of spaced-apart legs, a liner engagement pin mounted between the legs on a first side of the head aperture, and a first slot disposed normal to the pin on an opposite side of the head aperture; and the means for attaching and disattaching the head from the bolt adapter carrier assembly includes a rail guide that extends longitudinally from a first end to an opposite, second end, said second end having a tongue extension with a second slot for receiving the liner engagement pin, and said tongue extension being cut out on one side to receive one of the legs of a liner head and to permit the other leg to be placed adjacent to the tongue extension in side by side relation so that the legs straddle the tongue extension;

a support rail fixedly mounted to the rear end of the guide rail and extending part way toward the front end of the support rail;

a bolt slidably mounted on the guide rail for movement between the support rail and the front end of the guide rail, said bolt having a longitudinally-extended firing pin bore: and spring means for urging the bolt away from the support rail and into engagement with the head of a liner.

11. The combination of claim 10, wherein the spring means includes an apertured, rear lug mounted to the support rail;

an apertured, front lug mounted to the bolt;

a spring support pin disposed parallel to the guide rail and having a first end inserted into the apertured first lug and an opposite, second end inserted into the apertured, second lug; and a coil spring mounted on the spring support pin between the first lug and the second lug.

12. The combination of claim 11, wherein an exterior surface portion of the bolt is recessed to form a thumb depression in order to facilitate manual retraction of the bolt while attaching the head of a barrel liner to, or disengaging the head of a barrel liner from, the bolt adapter carrier assembly.

13. The combination of claim 12, wherein the first cartridge is a .22 caliber, rim-fire cartridge and the second cartridge is a .17 caliber, rim-fire cartridge.

14. The combination of claim 13, wherein the term "firearm" refers to an AR-15.

* * * * *